United States Patent [19]

Uematsu et al.

[11] Patent Number: 4,942,475

[45] Date of Patent: Jul. 17, 1990

[54] LIQUID DEVELOPMENT APPARATUS WITH PERFORATED LIQUID CARRIER SHEET

[75] Inventors: Ryosuke Uematsu; Kazunori Shindo; Yoshinobu Kariya; Shinro Oikawa, all of Tokyo, Japan

[73] Assignee: NEC Corporation, Tokyo, Japan

[21] Appl. No.: 324,863

[22] Filed: Mar. 17, 1989

[30] Foreign Application Priority Data

| | | | |
|---|---|---|---|
| Mar. 17, 1988 | [JP] | Japan | 63-65129 |
| Mar. 17, 1988 | [JP] | Japan | 63-65133 |
| Mar. 17, 1988 | [JP] | Japan | 63-65134 |
| Jul. 21, 1988 | [JP] | Japan | 63-183026 |
| Aug. 22, 1988 | [JP] | Japan | 63-209232 |
| Sep. 21, 1988 | [JP] | Japan | 63-237750 |

[51] Int. Cl.[5] ..... G03G 15/10

[52] U.S. Cl. ..... 355/256; 355/259; 355/262

[58] Field of Search ..... 355/256, 257, 258, 259, 355/260, 262, 263

[56] References Cited

U.S. PATENT DOCUMENTS

| | | | |
|---|---|---|---|
| 4,400,079 | 8/1983 | Landa | 355/256 |
| 4,410,260 | 10/1983 | Kuehnle | 355/256 |
| 4,493,550 | 1/1985 | Takekida | 355/256 |
| 4,504,138 | 3/1985 | Kuehnle et al. | 355/256 |

*Primary Examiner*—A. C. Prescott

*Attorney, Agent, or Firm*—Sughrue, Mion, Zinn, Macpeak & Seas

[57] ABSTRACT

An electrostatically charged image is applied to a smooth surface and moved past a development zone in which a carrier sheet perforated with a multitude of bores is also located. A layer of developing liquid is applied under gradually increasing pressure to a first surface of the carrier sheet so that the applied liquid squeezes through the bores to and beyond a second, opposite surface of the carrier sheet. The liquid emerges above the opposite surface of the carrier sheet to produce a multitude of part-spherical bulges. Field concentration occurs on the part-spherical surfaces of the individual tiny bulges. The first surface of the carrier sheet preferably exhibits lyophilic characteristic to the developing liquid, while the second surface exhibits lyophobic characteristic.

12 Claims, 9 Drawing Sheets

LIQUID DEVELOPMENT APPARATUS WITH PERFORATED LIQUID CARRIER SHEET

BACKGROUND OF THE INVENTION

The present invention relates to an apparatus for developing latent electrostatic images.

The current most used system for developing a latent electrostatic image for so-called "office copier" machines involves the steps of uniformly charging a photoconductor surface, exposing it to an imagewise radiation and developing the exposed surface by depositing colored particles on the latent images. Shortcomings of this dry developer are that the colored particles cause dust that stains delicate parts of the copying machine and that the deposited particles must be fixed by applying heat and pressure. Another system that has been proposed to overcome these shortcomings is one that employs an organic developing liquid of high electrical resistivity in which colored particles are dispersed. A recording medium carrying latent electrostatic images is submerged into the liquid. Development of liquid occurs when the colored particles are deposited on the latent images through what is known as "electrophoretic" process which is followed by drying the organic liquid. One shortcoming of this type of development is the deposition of colored particles in the background where no such deposits should be present. In addition, the drying process tends to warm the organic liquid, causing it to evaporate. To solve these problems, U.S. Pat. No. 4,202,620 discloses a liquid development apparatus in which a film of developing liquid is formed on the surface of a roller submerged in the liquid and moved past a latent electrostatic image that is formed on a photoconductor surface. As the film is brought close to the latent image, electrostatic fields develop and the liquid bulges by attraction from its surface and adheres to the charged image. Since the disclosed apparatus allows the use of water-soluble developing liquid, the drying process does not result in the vaporization of organic solvent.

However, one shortcoming of the prior art resides in the fact that field concentrations can occur in localized areas of a relatively wide, high density (colored) area, resulting in nonuniform distribution of field intensities, and hence "white blots" in an otherwise uniformly colored area. Furthermore, a localized field concentration accelerates its process and results in the clustering of small bulges into a single lump, and hence loss of fine details.

SUMMARY OF THE INVENTION

It is therefore an object of the present invention to provide a liquid development apparatus which permits the reproduction of uniformly colored areas and fine details.

According to the present invention, an electrostatically charged image is applied to a smooth surface and moved past a development zone in which a carrier sheet perforated with a multitude of bore is also located. A layer of developing liquid is applied under gradually increasing pressure to a first surface of the carrier sheet so that the applied liquid squeezes through the bores to and beyond a second, opposite surface of the carrier sheet. The first surface of the carrier sheet preferably exhibits lyophilic characteristic to the developing liquid, while the second surface exhibits lyophobic characteristic.

The liquid emerges above the opposite surface of the carrier sheet to produce a multitude of part-spherical bulges. Field concentration occurs on the part-spherical surfaces of the individual tiny bulges. Since such field concentrations spread uniformly over a relatively wide colored area and do not cluster, no "white blots" occur in a colored area and fine details can be reproduced.

In a preferred embodiment, the liquid is applied to the carrier sheet by a device comprising a container holding the liquid, a first support member having a smooth, part-cylindrical surface and a second rotary support member which is driven by a motor. The first support member is blased at a potential opposite to the electrostatic charges and the second support member is at least partially submerged in the developing liquid of the container. The carrier sheet is in the form of a loop and supported between the first and second support members so that the carrier sheet is moved around the part-cylindrical surface of the first support member under pressure. Alternatively, the first support member has a cylindrical surface which is coated with an electrically conductive elastic member. The looped carrier sheet is in pressure contact with the electrically conductive elastic member and moved in unison with it.

In a further preferred embodiment, the liquid applying device comprises a cylindrical rotary support member which is biased at the opposite potential, at least partially submerged in the developing liquid of the container, and is driven by motor. The carrirer sheet is in a pressure contact with part-cylindrical surface of the cylindrical rotary support member.

BRIEF DESCRIPTION OF THE DRAWINGS

The present invention will be described in further detail with reference to the accompanying drawings, in which.

DETAILED DESCRIPTION

Figure 1:
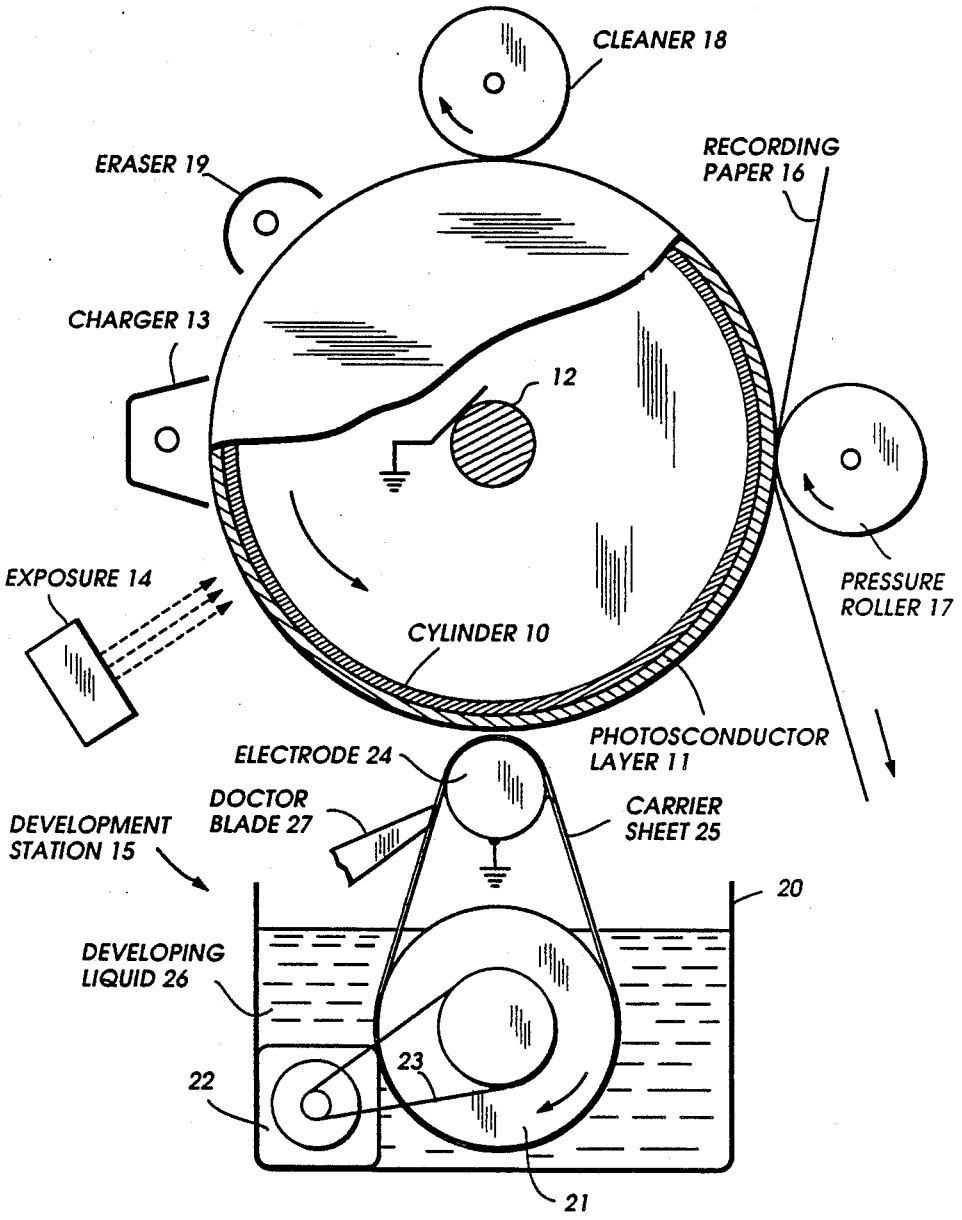
FIG.1 is a view of a liquid development apparatus according to first embodiment of the present invention.

Referring now to FIG. 1, there is shown a liquid development apparatus for latent electrostatic images according to a first embodiment of the present invention. The apparatus includes a cylinder 10 with a photoconductor layer 11 having a smooth surface and suitable means, not shown, to rotate the cylinder. The cylinder 10 is closed at the opposite ends by end plates which are secured to a rotary shaft 12 which is grounded. The function of the photoconductor cylinder 10 is to create latent electrostatic images on the photoconductor layer 11 as it turns counterclockwise about shaft 12 past a charging station 13 and an exposure station 14, cause the latent images to be developed by a development station 15 and to tranfer the developed images to a web, or recording sheet 16 by contact with a pressure roller 17. Photoconductor cylinder 10 further rotates past a cleaning station 18 and an erasure station 19 to remove residual development material and residual electrostatic charges.

The development station 15 comprises a liquid container 20 for holding development liquid 26 in which a rotary cylinder 21 is submerged and rotatable supported by the walls of the container 20. Drive means 22 rotates the cylinder 21 by a belt 23 in a clockwise direction. A stationary electrode 24 of cylindrical configuration, which is grounded, is located above the surface of the liquid. A perforated carrier sheet 25 is looped around cylinder 21 and electrode 24 so that a portion of the carrier sheet 25 is always submerged in the development liquid 26 to carry a layer of development liquid on its inner surface to an upper part-cylindrical smooth contact surface of the electrode 24. A doctor blade 27 is provided to scrape surplus liquid which may be attached to the outer surface of the carrier sheet 25.

Figures 2A, 2B:
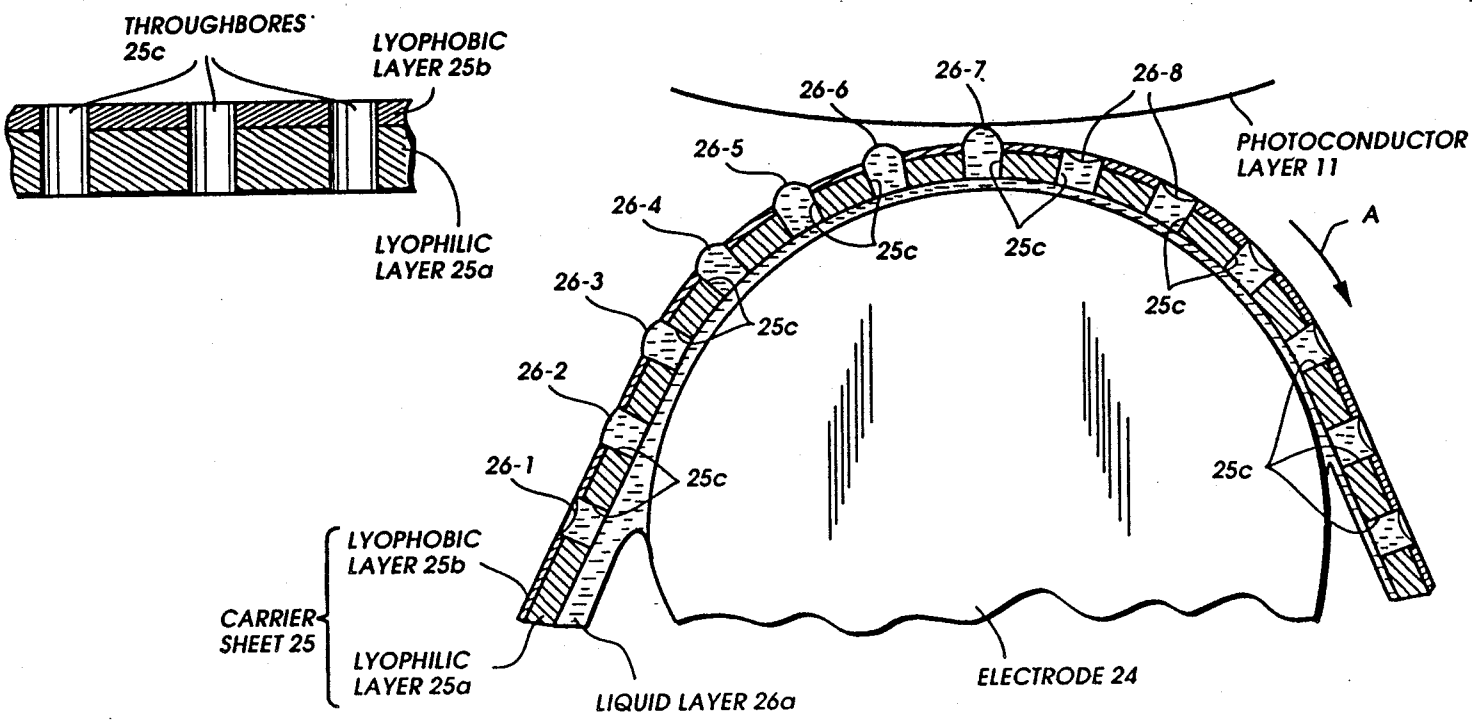
FIG. 2A is a partial, enlarged cross-sectional view of the carrier sheet of FIG. 1.
FIG. 2B is a side view of a portion of the apparatus of FIG. 1 illustrating the development liquid being squeezed between the carrier sheet and the stationary electrode of FIG. 1.

As illustrated in detail in FIG. 2A and 2B, the carrier sheet 25 comprises an inner layer 25*a* of lyophilic, or highly wettable material and a layer 25*b* of lyophobic, or less wettable material and is formed with a multitude of uniformly spaced apart, tiny throughbores 25*c*. Typically, the throughbores 25*c* have a diameter of 20 μm and are spaced a distance of 40 μm to 45 μm apart and the thickness of the carrier sheet 25 is 20 μm, so that the density is approximately 400 dots per inch. Suitable material for the lyophilic layer 25*a* and lyophobic layer 25*b* are polyimide and fluororesin, such as polytetrafluoethylene (PTFE).

As the perforated carrier sheet 25 is advanced, the development liquid in the container 20 sticks to the lyophilic layer 25*a* and forms a thin layer 26*a* as it emerges above the liquid surface and is drawn upward to the electrode 24. When the front edge of the drawn-up liquid layer 26*a* reaches an edge of the part-cylindrical contact surface of the electrode 24, it is squeezed between the contacting surfaces of the carrier sheet 25 and electrode 24 and forced to fill up the throughbores 25*c*. The pressure exerted on a given point of the liquid layer 26*b* increases as the carrier sheet is rotated clockwise until it reaches the point closest to the surface of the photoconductor layer 11. In proportion to the increasing pressure, liquid columns build up in the throughbores 25*c* on the approaching portion of carrier sheet 25 and emerge from the surface of the layer 25*b* to increasing heights as indicated by numerals 26-1 through 26-7. However, due to the liquid repellent characteristic of the upper lyophobic layer 25*b*, the emerging portions of the liquid columns are confined within the boundaries of throughbores 25*c*. Therefore, a multitude of part-spherical liquid bulges are created in an area adjacent the surface of the photoconductor layer 11, where they are attracted to it depending on the amount of positive electrostatic charges. When this occurs, the liquid columns in the receding portion of the carrier sheet 25 decrease below the surface of layer 25*b* as indicated at 26-8 due to the liquid-repellent nature of the layer 25*b*.

Figure 3A:
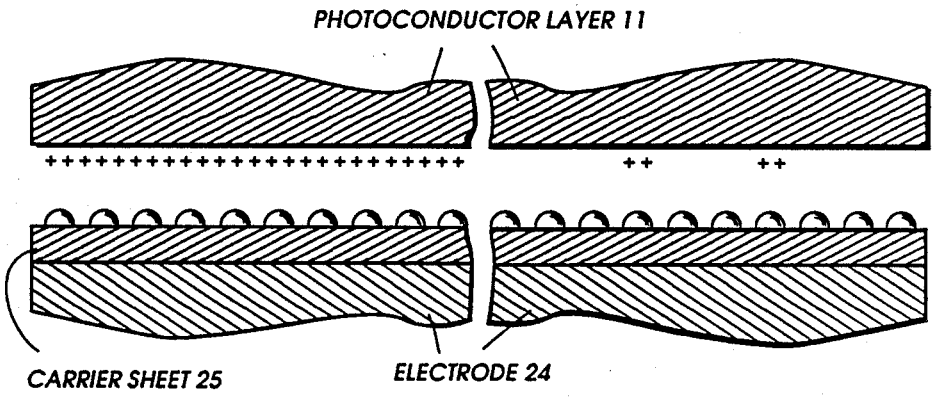
FIGS. 3A to 3C are views illustrating the process in which liquid bulges are adhered to different field density areas of a photoconductor surface.
Figure 3B:
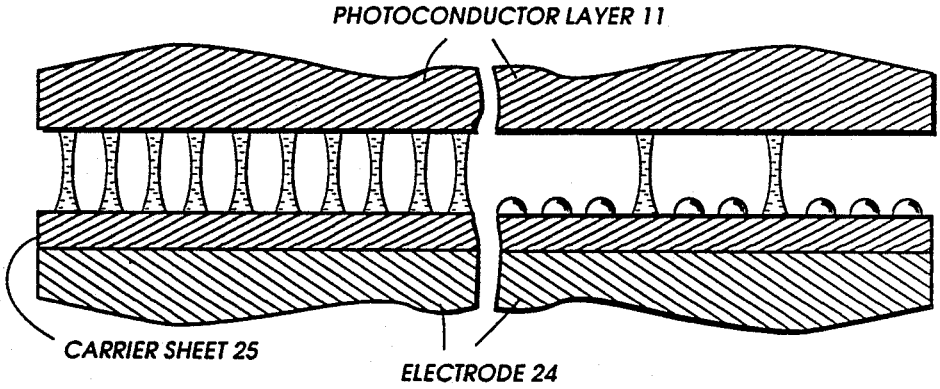
Figure 3C:
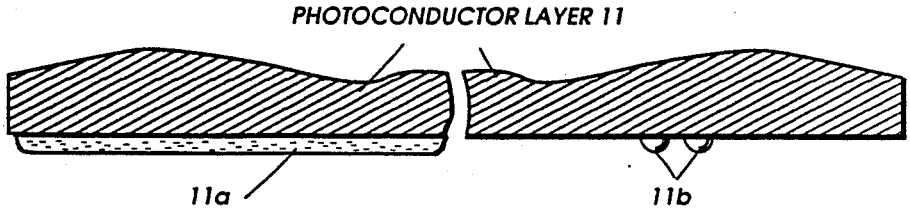

Due to the formation of liquid bulges on the surface of carrier sheet 25, positive charges in a high density, monotonous image area on the photoconductor layer 11 as shown at left of FIG. 3A cause electric fields to develop separately on the opposite surface of carrier sheet 25, as well as those of a low density, sundry image area shown at right of FIG. 3A, so that they grow in length and are transferred in a manner as shown in FIG. 3B, forming a thin uniform layer 11*a* on the left side of photoconductor layer 11 and separate dots 11*b* on the right side as shown in FIG. 3C. Therefore, undesired concentration of fields which would result in "white blots" in a high density (black) area can be avoided.

Figures 4A, 4B:
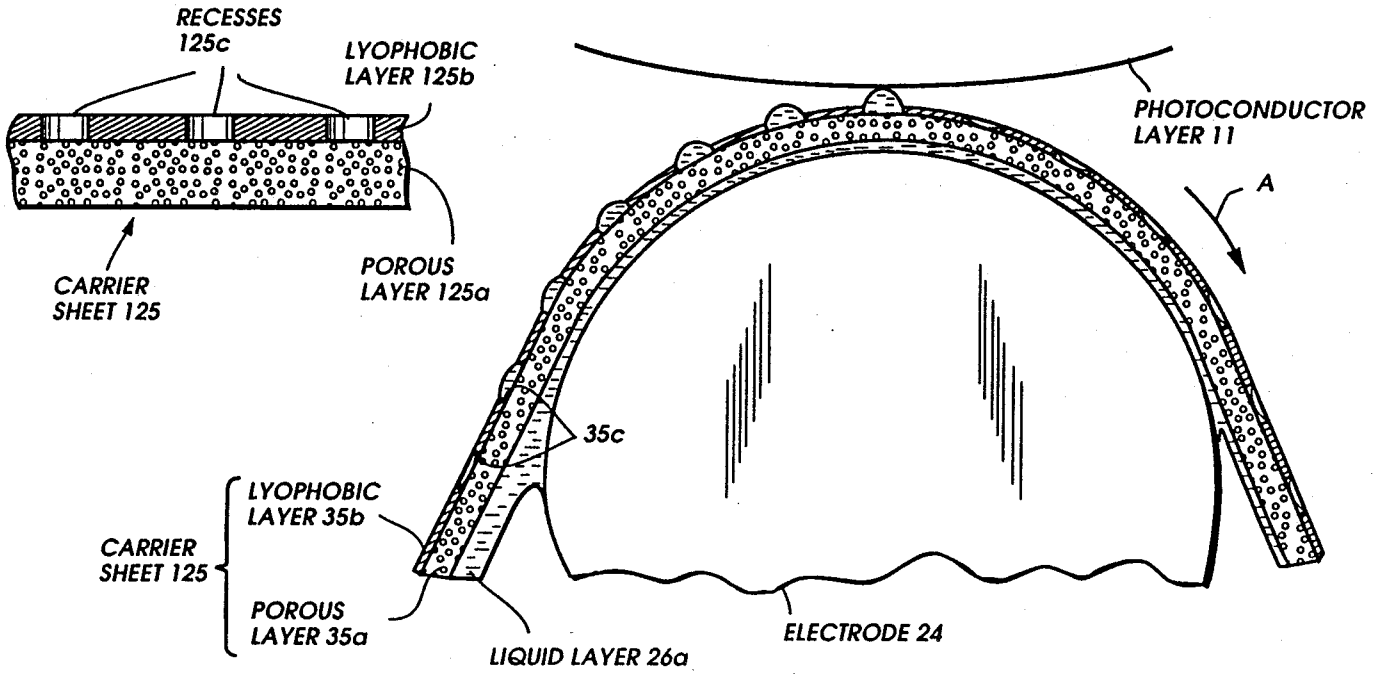
FIG. 4A is a partial, enlarged cross-sectional view of a modified form of the carrier sheet.
FIG. 4B is a cross-sectional view of a portion of the apparatus illustrating the development liquid being squeezed between the modified carrier sheet and the stationary electrode.

In a modified embodiment shown in FIG. 4A, a perforated carrier sheet 125 comprises an inner, porous layer 125*a*, such as polyurethane, and an outer lyophobic layes 125*b* which is formed with a multitude of throughbores 125*c* which extend down to porous layer 125*a*. Porous layer 125*a* absorbs development liquid in the container 20, forming a development liquid layer 26*a* which is drawn up as shown FIG. 4B by the carrier sheet 125 as it is rotated in the direction of arrow A and squeezing it between the inner layer 125*a* and the electrode 24. Due to the porosity of inner layer 125*a*, the squeezed development liquid is forced to permeate through it to the outer layer 125*b*. As in the previous embodiment, liquid columns build up in the throughbores 125*c* on the approaching portion of carrier sheet 125 to emerge from the surface of the layer 125*b* to increasing heights in the direction of rotation and those in the receding portion of the carrier sheet 125 decrease below the surface of layer 125*b*.

With carrier sheets 25 and 125 of the previous embodiments, the electrode 24 is described as being held stationary and having a hard conductive surface. However, to produce the pressure between the contact surfaces of the carrier sheet and electrode it is not necessary that the electrode 24 be stationary, but may be rotated at an appropriate speed in relation to the speed of rotation of the carrier sheet in a direction opposite to it, provided that the electrode 24 has a hard surface.

Figure 5:
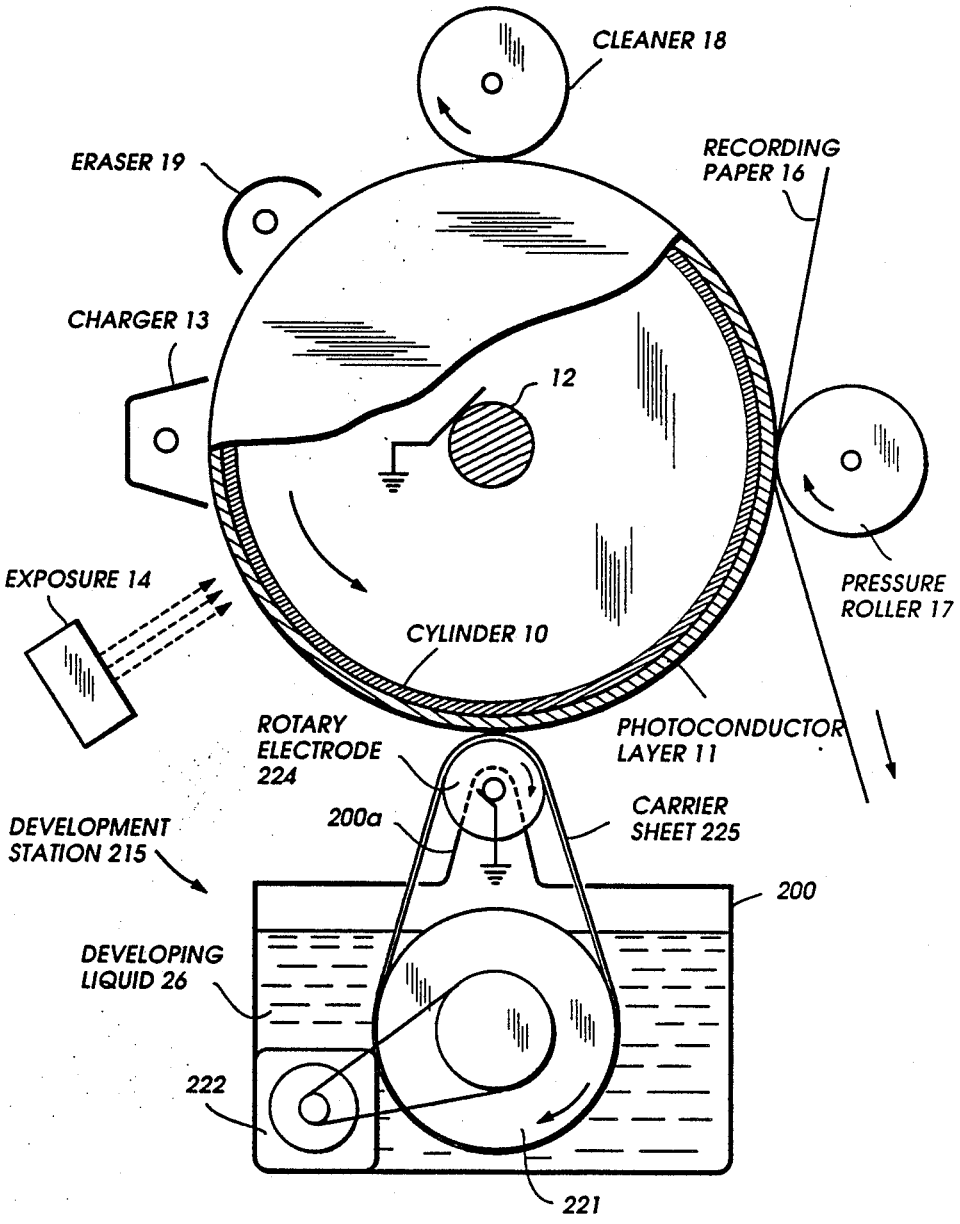
FIG. 5 is a view of a liquid development apparatus according to a modified embodiment of the present invention.
Figure 6B:
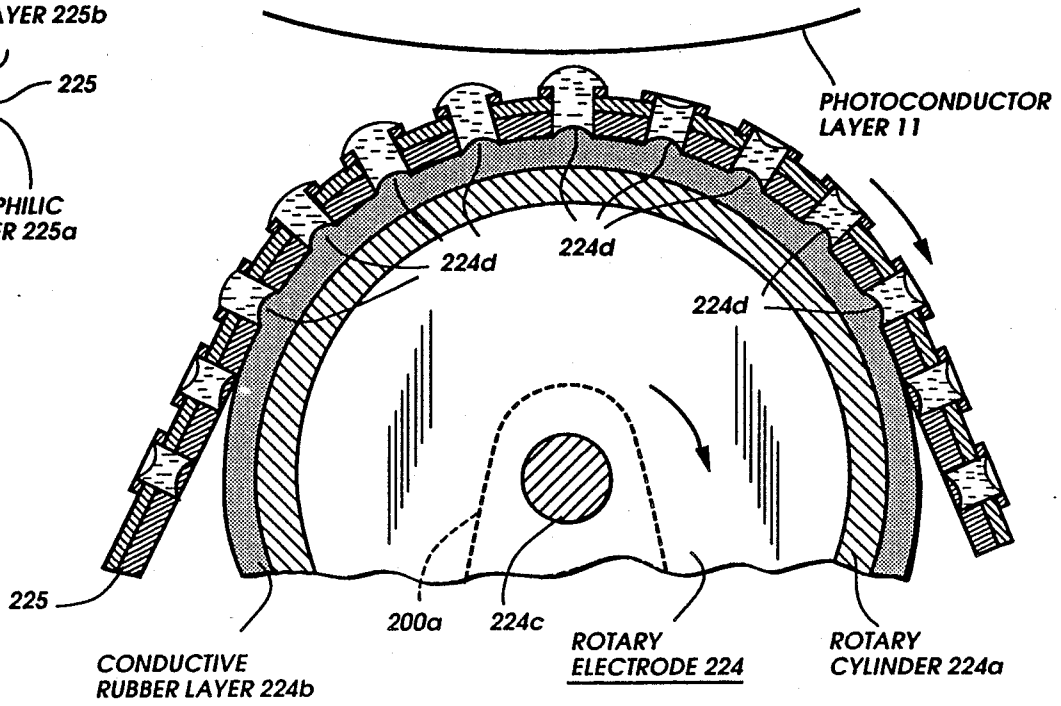
FIG. 6B is a side view of a portion of the apparatus of FIG. 5 illustrating the development liquid being squeezed between the carrier sheet and rotary electrode of FIG. 5.
Figure 6A:
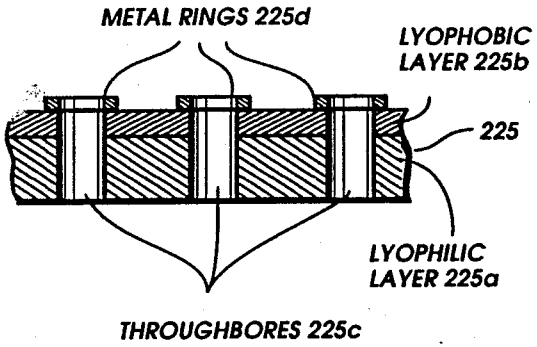
FIG. 6A is a partial, enlarged cross-sectional view of the carrier sheet of FIG. 5.

FIG. 5 is a modified embodiment of the present invention in which the apparatus includes a development station 215 which comprises a rotary electrode 224 and a perforated carrier sheet 225. As illustrated in FIG. 6B, rotary electrode 224 comprises a conductive rotary cylinder 224*a* and a conductive rubber layer 224*b* secured on the surface of the cylinder 224*a*. Cylinder 224*a* has a shaft 224*c* which is grounded and rotatably mounted on support 200*a* of liquid container 200. Carrier sheet 225 is formed of a lyophilic layer 225*a* and a lyophobic layer 225*a* as in the carrier sheet of FIG. 2A and formed with a multitude of throughbores 225c. Meetal rings 225d are secured to the upper edge of corresponding throughbores 225c as shown in FIG. 6A. Carrier sheet 225 is supported between the rotary cylinder 224 and the submerged rotary cylinder 221 which is driven by motor 222.

Conductive rubber layer 224b is sufficiently elastic so that portions 224d of its surface bulge outward into the bores 225c upon contact with the carrier sheet 225 as indicated in FIG. 6B, so that cylinder 224 and carrier sheet 225 rotate together at the same speed and liquid columns in the throughbores 225a on the approaching portion of carrier sheet 225 are pushed increasingly outward as it advances in the direction of arrow A, creating liquid bulges of increasing size. After emerging above the edge of metal rings, the liquid bulges tend to spread over the metal rings and swell due to the lyophilic characteristic of the rings 225d.

Metal rings 225d have the effect of concentrating electrostatic fields to the edges of the individual throughbores 225c as well as to the liquid bulges therein. The concentration of fields facilitates the growth of those liquid bulges where the field is strongest and accelerates the transfer of liquid bulges to the photoconductor layer 11. Therefores, small liquid bulges can be adhered to the photoconductor surface. Images can be reproduced to fine details without undesired white blots in this manner.

Figure 7:
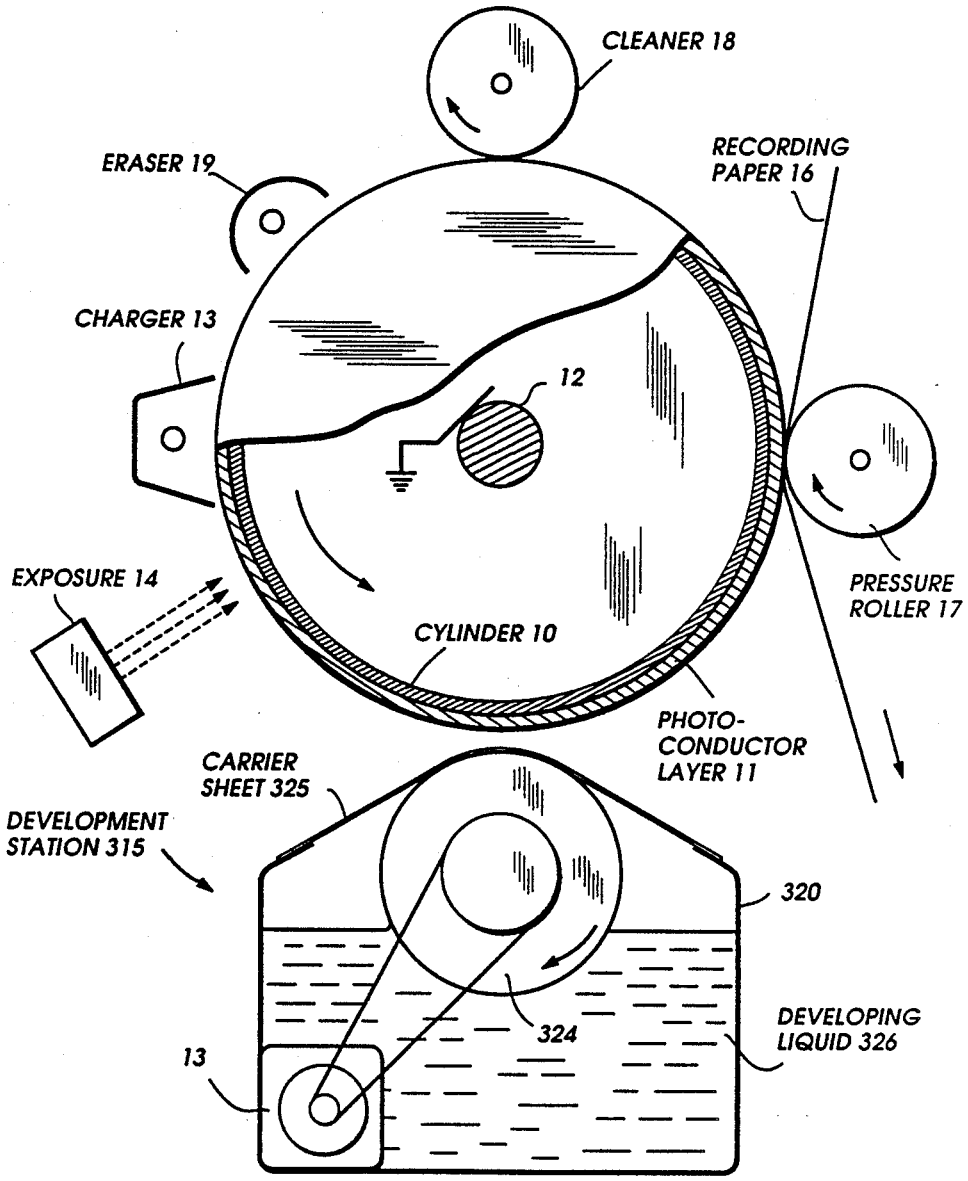
FIG.7 is a view of a liquid development apparatus according to a further modification of the present invention.
Figure 8A:
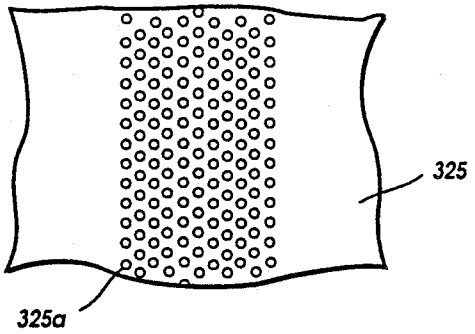
FIG. 8A is a partial, enlarged cross-sectional view of the carrier sheet of the embodiment of FIG. 7.
Figure 8B:
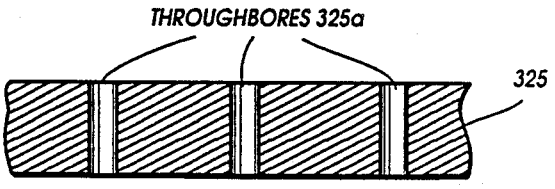
FIG. 8B is partial plan view of this carrier sheet.
Figure 9:
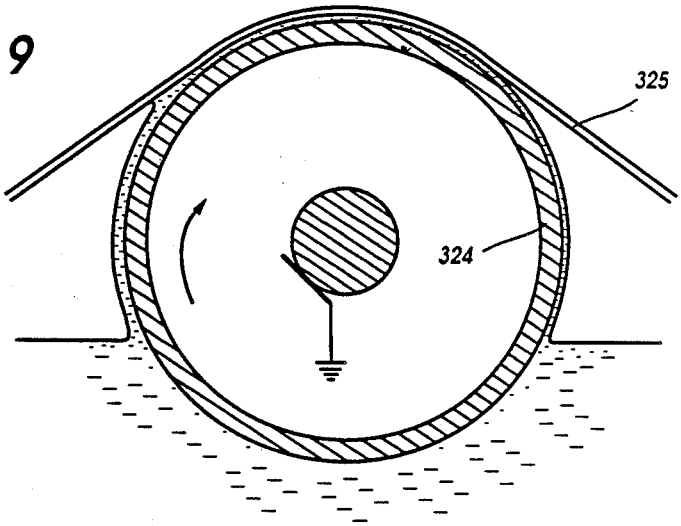
FIG. 9 is a side view of the rotary electrode and carrier sheet of FIG. 7.

FIG. 7 is an illustration of a further modification of the present invention. In this modification, development station 315 includes a rotary electrode 324 which is grounded and supported by liquid container 320 so that it is partially submerged in development liquid 326 and rotatably driven by motor 322. A carrier sheet 325 of lyophobic material is held stationary between opposed edges of the container 320 in pressure contact with an upper, part-cylindrical surface of the rotary electrode 324. As shown in FIGS. 8A and 8B, the contact area of carrier sheet 325 is perforated with a multitude of throughbores 325a. In FIG. 9, liquid 326 in the container is transported on the surface of rotary electrode 324 to the perforated area of carrier sheet 325 and squeezed therebetween, producing liquid bulges in a manner identical to those described in the previous embodiments.

Figure 10A:
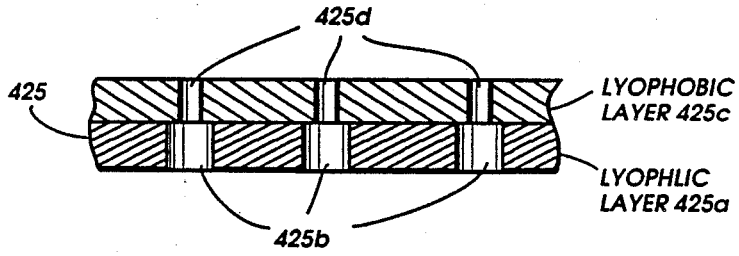
FIGS. 10A and 10B are partial, enlarged cross-sectional views of modified forms of the carrier sheet of FIG. 8B.
Figure 10B:
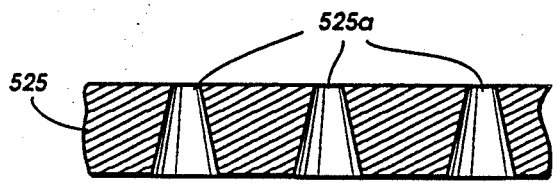

A preferred form of the stationary carrier sheet is shown in FIGS. 10A and 10B. In FIG. 10A, a carrier sheet 425 is shown as comprising a lower lyophobic layer 425a which is perforated with bores 425b of a smaller diameter and an upper lyophilic layer 425c correspondingly perforated with bores 425b of a larger diameter, with the smaller diameter bores 425d being centered with the corresponding larger diameter bore 325b. Liquid squeezed under pressure into the lower, larger diameter bores 425b is forced into the upper, smaller diameter bores 425d with a pressure higher than it is forced into the lower bore 425b. Therefore, liquid bulges can be made to project above the surface of upper layer 425c to a greater extent, facilitating the transfer of liquid to the photoconductor surface. Alternatively, a carrier sheet 525 is shown which is perforated with upwardly tapered throughbores 525a as illustrated in FIG. 10B.

Figure 11:
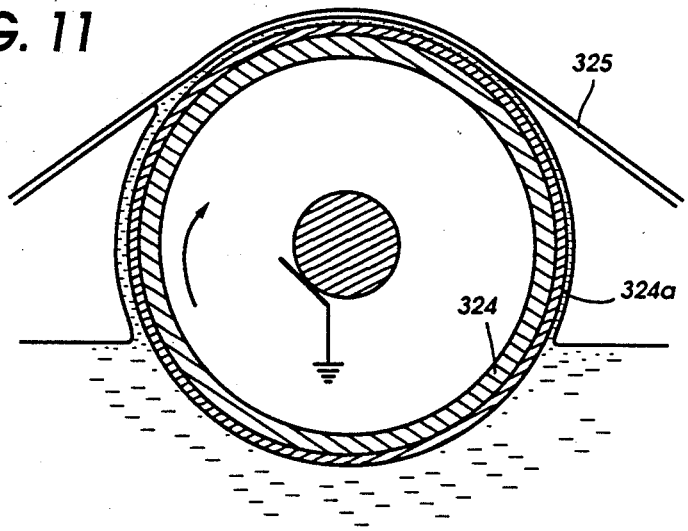
FIG. 11 is a side view of a modified form of the rotary electrode of FIG. 9.

The rotary electrode 324 is preferably coated with a lyophilic layer 324a as shown in FIG. 11 to increase the amount of liquid drawn up to the carrier sheet.

The foregoing description shows only one preferred embodiment of the present invention. Various modifications are apparent to those skilled in the art without departing from the scope of the present invention which is only limited by the appended claims. Therefore, the embodiment shown and described is only illustrative, not restrictive.

What is claimed is:

1. An apparatus for developing a latent electrotatic images, comprising:

a member having a smooth surface capable of having an electrostatically charged image applied thereto and capable of being driven so that charged image moves past a development zone;

means for applying a latent electrostatic charge image to said surface of said member;

a carrier sheet perforated with a multitude of bores, a portion of said carrier sheet being located in said development zone; and means for applying a layer of developing liquid under gradually increasing pressure to a first surface of said carrier sheet so that the applied liquid squeezes through the bores of said portion to and beyond a second, opposite surface of said carrier sheet, said liquid applying means being biased at a potential opposite to said latent electrostatically charged image.

2. An apparatus as claimed in claim 1, wherein said liquid applying means comprises:

a container holding said developing liquid;

a first suppor member biased at said opposite potential, said first member having a smooth, part-cylindrical surface;

a second rotary support member at least partially submerged in said developing liquid of said container; and means for driving said second rotary support member, said carrier sheet being in the form of a loop and supported between said first and second support members so that said loop of carrier sheet is moved around said part-cylindrical surface of said first support member under pressure.

3. An apparatus as claimed in claim 1, wherein said first surface of said carrier sheet and said bores exhibit a lyophilic characteristic to said developing liquid and said second surface of said carrier sheet exhibits a lyophobic characteristic to said developing liquid.

4. An apparatus as claimed in claim 1, wherein said carrier sheet comprises a first layer of lyophic material and a second layer of porous material, said first layer presenting said first surface of said carrier sheet and said second layer presenting said second surface of said carrier sheet, said bores being provided in said first layer.

5. An apparatus as claimed in claim 2, wherein said first surface of said carrier sheet and said bores exhibit a lyophilic characteristic to said developing liquid and said second surface of said carrier sheet exhibit a lyophobic characteristic to said developing liquid.

6. An apparatus as claimed in claim 2, wherein said carrier sheet comprises a first layer of lyophic material and a second layer of porous material, said first layer presenting said first surface of said carrier sheet and said second layer presenting said second surface of said carrier sheet, said bores being provided in said first layer.

7. An apparatus as claimed in claim 1, wherein said liquid applying means comprises:

a container holding said developing liquid;

a first cylindrical rotary support member biased at said opposite potential, said first member having an electrically conductive elastic surface;

a second cylindrical rotary support member at least partially submerged in said developing liquid of said container; and means for driving said second cylindrical rotary support member, said carrier sheet being in the form of a loop and supported between said first and second rotary support members so that said loop of carrier sheet is in pressure contact with said electrically conductive elastic surface of said first cylindrical rotary support member and moved in unison therewith.

8. An apparatus as claimed in claim 7, wherein each of said bores has an electrically conductive ring on the side of said first surface of the carrier sheet.

9. An apparatus as claimed in claim 1, wherein said liquid applying means comprises:

a container holding said developing liquid; and a cylindrical rotary support member biased at said opposite potential and at least partially submerged in said developing liquid of said container;

means for driving said cylindrical rotary support member, said carrier sheet being in a pressure contact with a part-cylindrical surface of said cylindrical rotary support member.

10. An apparatus as claimed in clain 8, wherein said cylindrical rotary support member has a lyophilic cylindrical surface.

11. An apparatus as claimed in claim 8, wherein said bores are tapered in a direction from the second to the first surface of said carrier sheet.

12. An apparatus as claimed in claim 8, wherein said carrier sheet has a first, lyophobic layer presenting said first surface and a second, lyophilic layer presenting said second surface, said first layer having a multitude of smaller diameter bores and said second layer having a multitude of larger diameter bores communicating to corresponding ones of said smaller diameter bores.

* * * * *

UNITED STATES PATENT AND TRADEMARK OFFICE

CERTIFICATE OF CORRECTION

PATENT NO. : 4,942,475

DATED : July 17, 1990

INVENTOR(S) : Uematsu et al.

It is certified that error appears in the above-identified patent and that said Letters Patent is hereby corrected as shown below:

Col. 1, line 62, delete "bore" and insert --bores-.

Col. 2, line 15, delete "blased" and insert --biased--.

Col. 2, line 31, delete "carrirer" and insert --carrier--.

Col. 3, line 23, delete "tranfer" and insert --transfer--.

Col. 4, line 21, after "separately" insert --on the nearest liquid bulges--.

Col. 4, line 33, delete "layes" and insert --layer--.

Signed and Sealed this

Twenty-eighth Day of April, 1992

*Attest:*

HARRY F. MANBECK, JR.

*Attesting Officer*

*Commissioner of Patents and Trademarks*